US009520674B2

(12) United States Patent
Regnier et al.

(10) Patent No.: US 9,520,674 B2
(45) Date of Patent: Dec. 13, 2016

(54) CONNECTOR ASSEMBLY WITH DUAL SECONDARY LOCK

(71) Applicant: Delphi International Operations Luxembourg S.A.R.L., Bascharage (LU)

(72) Inventors: Vincent Regnier, Nuremberg (DE); Rene Lehmann, Fuerth (DE)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 0 days.

(21) Appl. No.: 14/795,978

(22) Filed: Jul. 10, 2015

(65) Prior Publication Data

US 2016/0013583 A1 Jan. 14, 2016

(30) Foreign Application Priority Data

Jul. 11, 2014 (EP) ..... 14176820

(51) Int. Cl.
*H01R 13/627* (2006.01)
*H01R 13/639* (2006.01)

(52) U.S. Cl.
CPC ..... *H01R 13/6273* (2013.01); *H01R 13/639* (2013.01)

(58) Field of Classification Search
CPC ..... H01R 13/639; H01R 13/6273
See application file for complete search history.

(56) References Cited

U.S. PATENT DOCUMENTS 6,328,589 B1 * 12/2001 Annecke ..... H01R 13/501 439/352
6,419,510 B2 * 7/2002 Shiraki ..... H01R 13/7032 439/188
6,530,799 B2 * 3/2003 Regnier ..... H01R 13/639 439/352
7,559,783 B2 * 7/2009 Ripper ..... H01R 13/68 439/188
2002/0081888 A1 * 6/2002 Regnier ..... H01R 13/639 439/352
2004/0127087 A1 * 7/2004 Hirschmann ..... H01R 13/639 439/357
2006/0154510 A1 * 7/2006 Annecke ..... H01R 13/6273 439/352

(Continued)

FOREIGN PATENT DOCUMENTS

DE 10005858 A1 8/2001
WO 9741623 A1 11/1997
WO 2014072081 A1 5/2014

OTHER PUBLICATIONS

European Search Report for Application EP 14176820, published Jan. 6, 2015.

*Primary Examiner* — Briggitte R Hammond
(74) *Attorney, Agent, or Firm* — Robert J. Myers

(57) ABSTRACT

The present invention relates to a connector assembly for airbag restraint systems. The connector assembly comprises a connector housing and secondary locking means assigned to the connector housing. The secondary locking means is arranged movable relative to the connector housing and can be moved from an open position to a locked position. Further the secondary locking means comprises two separate locking members wherein each of the two separate locking members is configured to be independently movable.

13 Claims, 4 Drawing Sheets

(56) References Cited

U.S. PATENT DOCUMENTS

| | | | | |
|---|---|---|---|---|
| 2009/0152837 | A1* | 6/2009 | Son | F42B 3/04<br>439/345 |
| 2014/0287611 | A1* | 9/2014 | Gunreben | H01R 13/6273<br>439/354 |

* cited by examiner

CONNECTOR ASSEMBLY WITH DUAL SECONDARY LOCK

CROSS-REFERENCE TO RELATED APPLICATION

This application claims the benefit under 35 U.S.C. §119 (a) of European Patent Application No. 14176820.0, filed in the European Patent Office on Jul. 11, 2014, the entire disclosure of which is hereby incorporated by reference.

TECHNICAL FIELD OF THE INVENTION

The present invention relates to a connector assembly, in particular for airbag restraint systems. The connector assembly comprises a connector housing and secondary locking means. The secondary locking means is assigned to the connector housing so that it is movable relative to the connector housing from an open position to a locked position.

BACKGROUND OF THE INVENTION

In many applications, the safe coupling of connectors is of high importance. For example, in the case of car safety systems, as e.g. airbag systems in passenger cars, the connectors used for the connection of an airbag to its ignition base have to be provided with reliable safety systems. To ensure that the connectors cannot become loose unintentionally, secondary locking means are used in addition to the primary locking means to guarantee a safe mechanical coupling.

An example of a connector with a secondary locking means is described in WO 97/41623 A1. This document discloses a connector which can be mated with a corresponding counter-connector being part of an airbag ignition mechanism. In assembled condition, (i.e. the connector is mated with the corresponding counter-connector), the connector is fixed to the counter-connector by means of flexible latching arms. During mating of the connectors, these arms are deflected and snap back into corresponding latching clearances of the counter-connector, when fully mated. For securing the mechanical coupling of the connectors, WO'623 suggests a secondary locking means that comprises locking arms that can be inserted into the mated connector assembly. Once the locking arms are inserted, they inhibit bending of the latching arms out of the corresponding latching clearances. Thus, the mechanical coupling of the connectors is secured.

A further development of a secondary locking means is disclosed in the patent application DE 100 05 858 A1. This document discloses a connector with a secondary locking device and a safety spring element, which serves to hold the secondary locking means in a position, in which the secondary locking means is mounted to the connector housing so that it does not hinder mating or un-mating of the connector with a corresponding counter-connector.

In patent application WO 2014/072081 A1, a connector assembly is disclosed that comprises a secondary locking means and a spring. The secondary locking means and the spring are assigned to a connector housing. Hereby the secondary locking means is movable between a first and a second position. When placed in its second position, it serves to secure the mating of the connector housing to a corresponding counter-connector. During mating, the spring is biased to cause the secondary lock to move automatically into a locked position when the connector assembly is fully mated with is corresponding counter-connector, without need for an operator to push the secondary locking means into the locked position.

The connector assemblies described above have in common that a partial mating of the connector and the corresponding counter-connector is possible, in which case the secondary locking means do not function satisfactorily.

If the connector is only partially mated, it might occur that the connector assembly electrically functions correctly, since the electrical contacts of the connector and the corresponding counter-connector are connected (i.e. current conduction is possible), but the mechanical connection is not according to the desired specification. In a highly safety relevant connector assembly, for example in airbag restraint systems, often detecting devices are integrated that are able to detect a correct mating of the counter-connectors based on electrical circuits that are opened respectively closed during the mating of the connector. If the connector and the corresponding counter-connector are partially mated, these detecting devices may report untruly a correct mating of the connectors. Further, with the prior art secondary locking means it was often possible to move the same in the locked position, thereby indicating to an operator, that the mating is complete. However, in case of only a partial mating, the prior art secondary locking means often fail to provide the desired secondary locking function. In the case of e.g. airbag restraint systems the electrically functional but mechanical disturbed connector might disengage due to vehicle vibration.

BRIEF SUMMARY OF THE INVENTION

The present application relates to a connector assembly, in particular for airbag restraint systems. The connector assembly comprises a connector housing and secondary locking means (i.e. a secondary lock).

The connector housing comprises at least one primary latching arm configured to latch with a corresponding counter-connector. The connector housing may comprise a plug-in portion and at least two primary latching arms that are arranged on opposite sides of the plug-in portion, whereby the plug-in portion enters the corresponding counter-connector at least partly upon mating. The latching arms of the plug-in portion are deflected during mating and snap back into corresponding latching grooves or recesses provided in the counter-connector, when mated. Thereby each latching arm can be deflected and mated individually.

The secondary locking means is assigned to the connector housing, and is arranged movable relative to the connector housing from an open position to a locked position. The secondary locking means may be guided in its movability by the connector housing, so that the trajectory from an open to a locked position of the secondary locking means is defined. The same applies for the movement of the secondary locking means form the locked in the open position.

After at least one of the latching arms is in its mated position, the secondary locking means can be moved in the mating direction, in accordance with the defined trajectory. The end point of said trajectory is defined as the locked position.

The secondary locking means comprises further blocking portions that are configured to block a release movement of the latching arms when the secondary locking means is in its locked position. These blocking portions of the secondary locking means may be arranged relative to the latching arms of the plug-in portion so that a deflection of the latching arms is made impossible or at least hindered. Thus, the latching arms cannot be released and the connector is secured by the latching arms and the blocking portions in the mated condition.

Advantageously, the secondary locking means of the invention comprises two separate locking members. The separate locking members are thereby two physical different parts. The two separate locking members may be formed symmetrically identical. However, any other suitable shaping of the separate locking members is possible. Further, each of the two separate locking members is assigned to one of the primary latching arms to block a release movement of the assigned latching arm. Thereby, each of the two separate locking members is configured to be independently moveable between the open position and the locked position along its own trajectory. Therefore, if the connector is unintentionally only partially mated, i.e. only one of the two latching arms is latched in its latching groove, the locking member assigned to the latched (i.e. mated) latching arm can be moved in its locked position, even if the locking member assigned to the not-latched latching arm cannot.

In this locked position, the single locking member blocks a release movement of the latched latching arm and the connector is sufficiently secured, even in such a partially mated condition. This secured, partially mated condition provides retention forces that are strong enough to avoid an unintentional disengagement of the connector.

According to one embodiment, the connector assembly is further provided with a spring, that is operationally connected to at least one of the locking members and possibly to both of the locking members, to bias the respective locking member into its locked position when the connector housing is fully mated with a corresponding counter-connector. Thus, the spring is configured to urge the locking members to move automatically into their locked position when the assigned latching arm of the connector housing is mated with is corresponding counter-connector without need for an operator to push the secondary locking member manually into the locked position.

The secondary locking members may each comprise at least one blocking portion, which is configured to block a release movement of the latching arm(s) when the secondary locking means is in the locked position. The blocking portion can for example be arranged on a dedicated element such as an actuating arm of the locking member or can be provided for example as part of other functional members of the locking member. This blocking portion may be arranged such that it blocks the latching arms of the connector housing in their respective positions, when the secondary locking means is in the locked position. Each locking members may further comprise at least one actuating arm each configured to latch to a corresponding counter-connector when mated and when the secondary locking means is in its locked position. Thereby, the locking member can be secured in the locked position.

In one embodiment, the connector assembly is further provided with a shortening element, which allows the monitoring of the mating process, respectively the monitoring of a correct mating between connector housing and corresponding counter-connector. The shortening element is an electrical contact element and configured to be actuated upon mating by coming into contact with a portion of the corresponding counter-connector. Thereby, the shortening element is disposed, to close or open an electrical circuit. The opening or closing of the electrical circuit allows a remote monitoring of the mating process. To this end, the shortening element may be provided such on the connector housing, that it is only disposed (thereby opening or closing the electrical circuit), upon fully and correct mating of counter-connector and connector housing.

Generally, the connector assembly of the present invention may also further comprise a corresponding counter-connector and the corresponding counter-connector may be an airbag squib socket and the connector housing accordingly may be an airbag squib connector housing.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

In one aspect, the present invention improves the state of the art by providing a connector assembly with an improved secondary locking mechanism.

Figure 1:
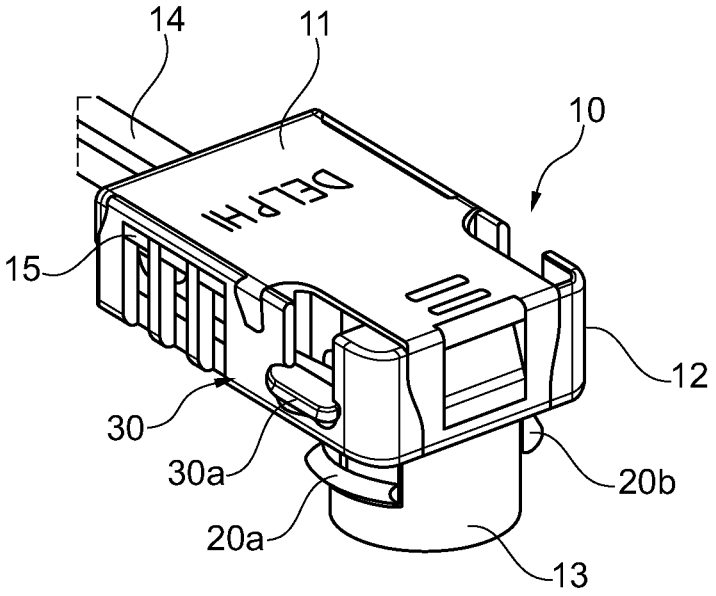
FIGS. 1 and 2 show schematic illustrations of a connector housing comprising two separate locking members in accordance with the present invention from different views.

FIG. 1 shows a perspective, three-dimensional view of a connector housing 10 in accordance with the invention. The connector housing 10 comprises a main body 12 and a cover 11 which is removably latched to the main body 12 by means of latch connections 15. At the bottom side of the main body 12 a cylindrical plug-in portion 13 is provided. The skilled person will recognize that the plug-in portion 13 is configured to co-operate with typical airbag squib sockets and that the device shown is thus an airbag squib connector. On opposite sides of the plug-in portion 13, two latching arms 20*a*, 20*b* are arranged. In other words, the two latching arms 20*a*, 20*b* are arranged symmetrically on opposite sides of the plug-in portion 13. The latching arms 20*a*, 20*b* provide the primary locking of the connector. Indicated by the reference number 30, a secondary locking means is arranged moveable inside of the main body 12 of the connector housing 10. Secondary locking means 30 is shown in its locked position and consists of two distinct locking members 30*a* and 30*b*. When coupled or mated to a corresponding counter-connector, the secondary locking means 30 will prevent an unintentional un-mating of the two connector parts, when in the position shown in FIG. 1.

Figure 2:
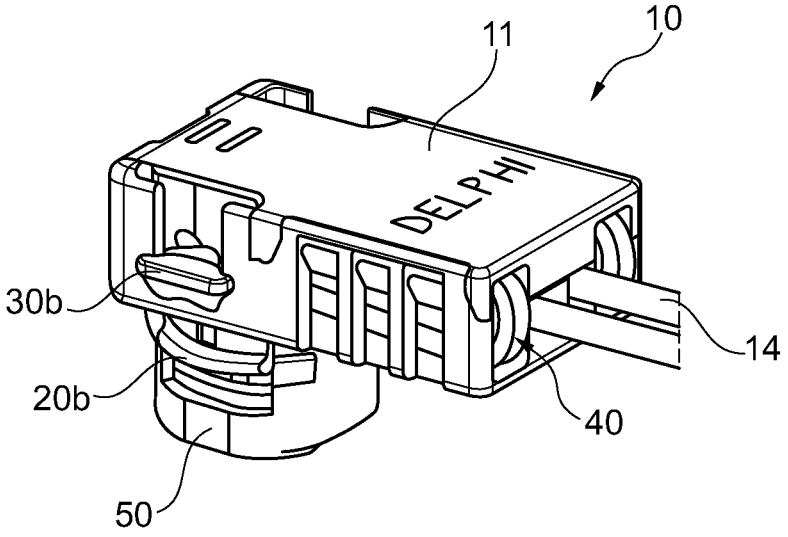

FIG. 2 shows the same device from a different angle. Further, in FIG. 2 a retainer 50 is shown for illustrative purposes. The skilled person will recognize that the retainer 50 is part of an airbag squib socket and thus forms part of the corresponding counter-connector. Also visible in the view of FIG. 2 is the spring 40, which biases the secondary locking means 30 into its locked position. The spring 40 is such arranged in the connector housing 10 that upon mating the spring 40 will automatically move the secondary locking means 30 in the locked position shown in for example FIG. 2.

FIG. 3 shows again the same arrangement as FIG. 2 from a different perspective, however with the cover 11 removed to allow a view of the interior construction of the connector housing 10. From FIG. 3 one can see that cables 14 are mounted inside of the connector housing 10. The cables 14 are partially covered by a ferrite element 16, as it is well known to the skilled person. In the open view of FIG. 3 one can see that the spring 40 is made from a single wire of spring steel. Further, each locking member 30*a*, 30*b* comprises an actuating arm 31*a*, 31*b* (only actuating arm 31*b* is visible in FIG. 3 due to the perspective).

Spring 40 comprises in the embodiment shown two spring arms 41*a*, 41*b* that are operationally connected to the locking members 30*a* and 30*b*. Further, as one can take from FIG. 2 or 3, the coils 42 are arranged, such that the winding axis of each coil 42 is in a plane perpendicular to the mating direction of the connector housing 10. It is clear for the skilled person, that the shown spring 40 is only one example and that it is possible to use also other constructions without deviating from the core idea thereof.

Turning back to FIG. 3, one can see that the spring 40 is tensioned when the locking members 30*a*, 30*b* are in their open position. Upon mating, the spring 40 will automatically move the locking members 30*a*, 30*b* in the locked position. How this is achieved will be explained in more detail in the following with regard to FIGS. 6 and 7.

Figure 3:
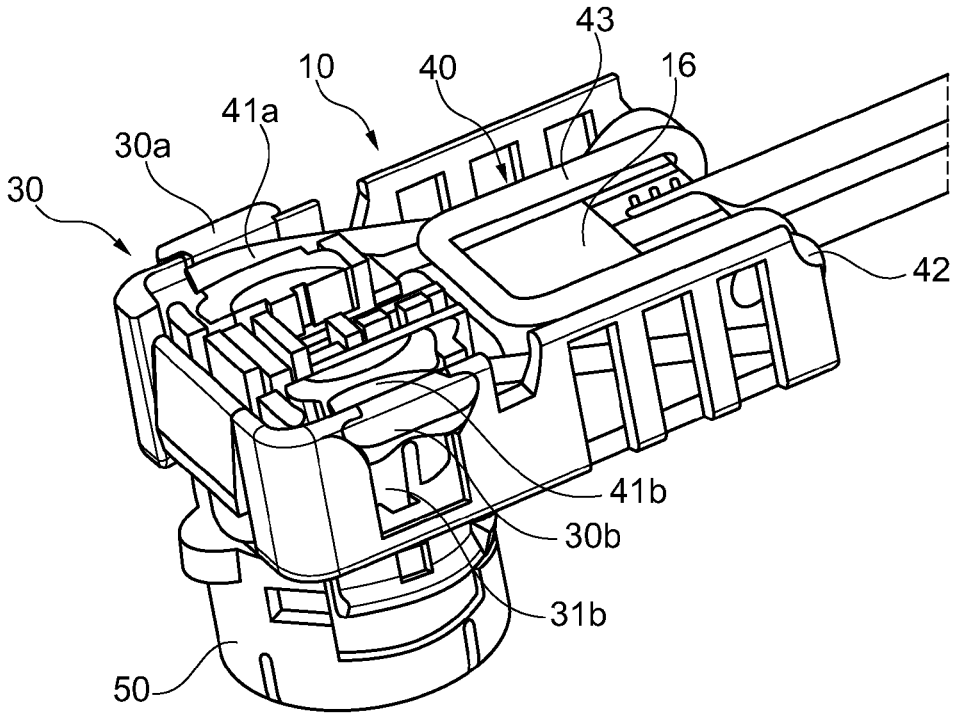
FIG. 3 shows a schematic illustration of the connector housing illustrated in FIGS. 1 and 2, whereby the cover of the connector housing is removed.
Figure 4:
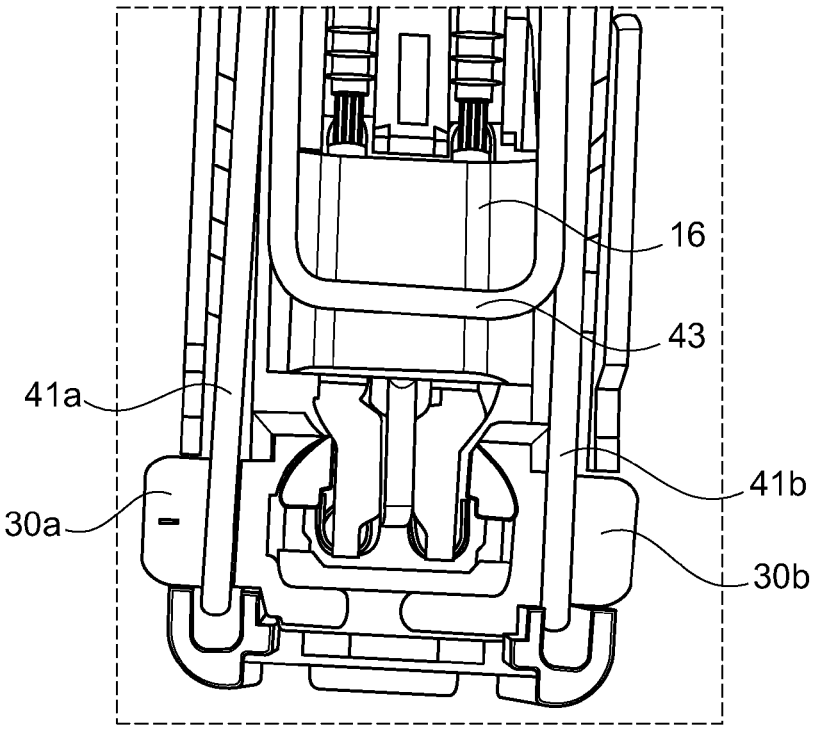
FIG. 4 shows a top view of the connector housing with removed cover.

Turning back to FIGS. 3 and 4, one can see how the two spring arms 41*a*, 41*b* of spring 40 are operationally connected to the respective locking members 30*a*, 30*b* of the secondary locking means 30. The position of secondary locking means 30 shown in FIGS. 3 and 4 is the so called open position. In this position it is possible to fully mate the connector housing 10 with the corresponding counter-connector, since the secondary locking means 30, i.e. the locking members 30*a*, 30*b* do not block the latching arms 20*a*, 20*b*.

The spring 40 in accordance with the present invention comprises at least two spring arms 41*a*, 41*b* each actuating arm 31*a*, 31*b* being operationally connected to a respective one of the two locking members 30*a*, 30*b*, for biasing the locking members 30*a*, 30*b* individually in their locked position. This can for example be achieved, by a direct contact of the spring arm 41*a*, 41*b* and the locking members 30*a*, 30*b*, however, it could also be achieved indirectly by further elements which are being provided between the actuating arm 31*a*, 31*b* and the locking member 30*a*, 30*b*. It is however important, that the actuating arm 31*a*, 31*b* actively pushes or moves the locking member 30*a*, 30*b* from the open position into the locked position upon mating of connector housing 10 and corresponding counter-connector.

Figure 5:
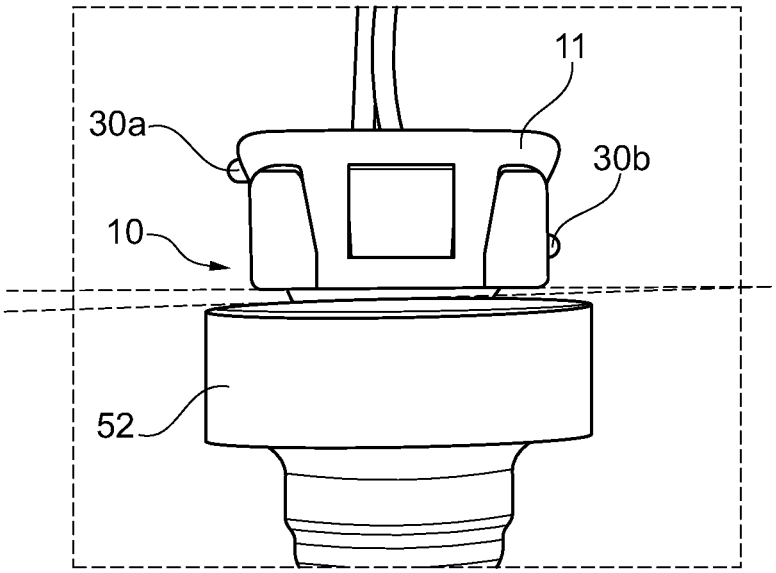
FIG. 5 shows a side view of the connector housing in a partially mated and locked condition.

FIG. 5 shows the connector housing 10 in a partially mated condition, which might occur, if only one side of the edge of the connector housing 10 is pushed down. As a result, the connector housing 10 is mated oblique into the corresponding counter-connector. Locking member 30*a* is still in its open position, whereas locking member 30*b* has been moved to its locked position. The retention force of a partially locked connector is greater than 78 newtons (N) and may be greater than 135N. The retention force is the force that is necessary to unmate the connector housing 10 and the corresponding counter-connector when pulled in mating direction. The retention force is measured according to the test method described in ISO 19702-2, §4.4.

Figure 6:
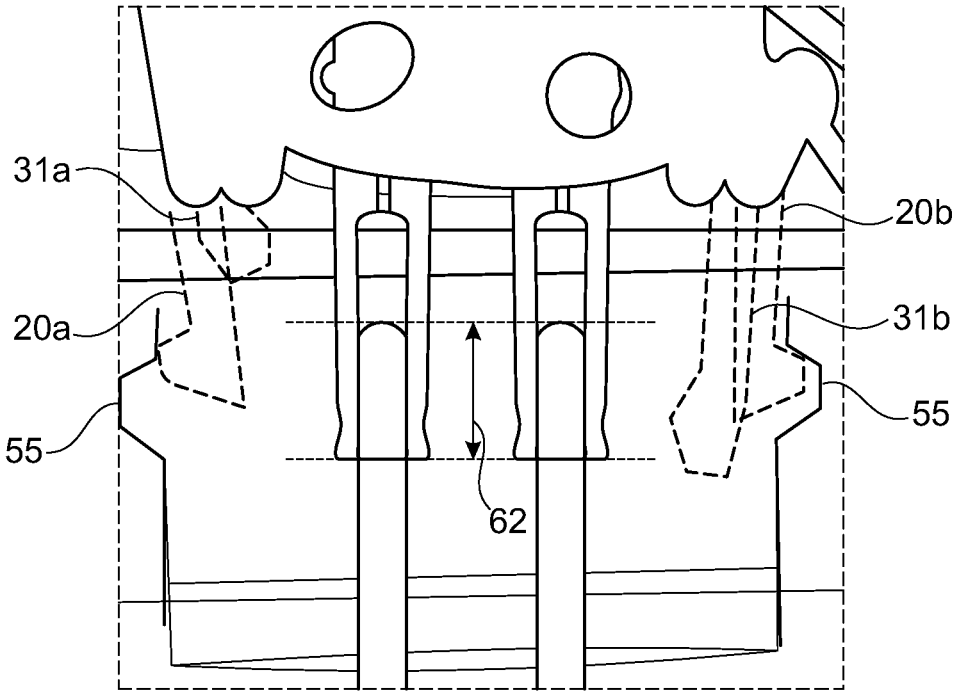
FIG. 6 shows an X-ray photo of the connector housing of FIG. 5 in a partially mated and locked condition.

FIG. 6 shows an X-ray photo of the partially mated connector. To facilitate the understanding, the latching arms 20*a*, 20*b* and the actuating arms 31*a*, 31*b* of the locking members 30*a*, 30*b* are retraced. As one can see on the right side of FIG. 6, latching arm 20*b* is latched to the latching groove 55 and actuating arm 31*b* of locking member 30*b* blocks the latching arm 20*b*, since the locking member 30*b* is in its locked position. Latching arm 20*a* is not latched, i.e. only a partial mating of connector housing 10 and corresponding counter-connector occurs. Further, since the latching arm 20*a* is not latched, the locking member 30*a* with actuating arm 31*a* is still in its open position. Nevertheless, since the other locking member 30*b* is in its locked position, the connection is sufficiently secured.

Figure 7:
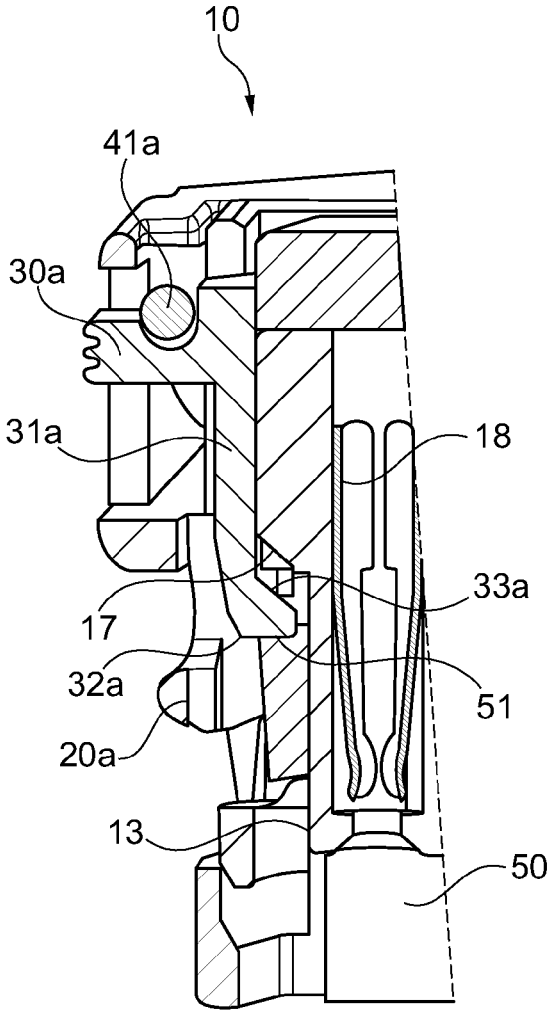
FIG. 7 shows a partially cut view illustrating the interior of the connector housing upon mating in the open position.

FIG. 7 shows a partially cut view of the connector during the mating process. From the cut view, one can see how the plug-in portion 13 is partially inserted into the retainer 50. In the position shown, a stop member 51 of retainer 50 comes into blocking contact with a first actuating surface 32*a* provided at the free end of an actuating arm 31*a* of the locking member 30*a*. Thereby, upon movement of the connector housing 10 in mating direction into the retainer 50, the locking members 30*a*, 30*b* remain un-moved, i.e. they are hindered from moving in the mating direction since the first actuating surface 32*a* rests on stop member 51. Due to this blocking of the locking members 30*a*, 30*b* (due to the symmetrical arrangement, also the locking member 30*b* rests on a corresponding stop member 51 of the retainer 50) the locking members 30*a*, 30*b* will bias the spring 40 when the connector housing 10 is moved into the mated position. In the position shown in FIG. 7, the spring arms 41*a*, 41*b* of the spring 40 are thus under high tension and basically in the same position as shown in FIGS. 3 and 4. However, since the locking members 30*a*, 30*b* still rest firmly on the stop member 51, the spring 40 cannot yet move the locking members 30*a*, 30*b* into the locked position shown in FIGS. 1, 2 and 8.

Figure 8:
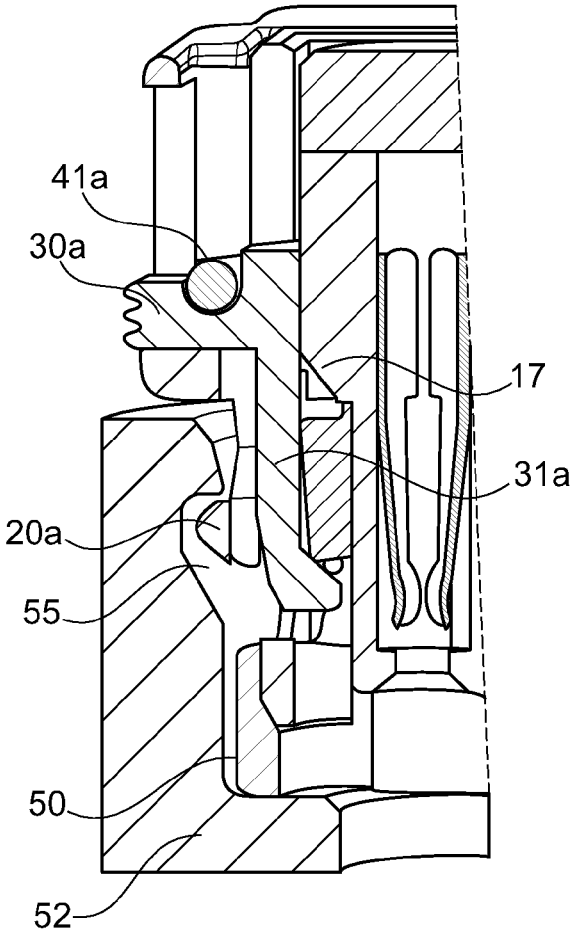
FIG. 8 shows the same partial cut as FIG. 7, however, with the locking member 30*a* in its locked position.

This is accomplished by means of an inclined deflection surface 17 provided in the connector housing 10. This inclined deflection surface 17 comes into contact with a second actuating surface 33*a* of actuating arm 31*a* at the end of the mating process. A corresponding surface will have the same effect on actuating arm 31*b*. When this happens, the inclined deflection surface 17 will push the actuating arm 31*a* of the locking member 30*a* outwardly, i.e. away from the plug-in portion 13. The skilled person will recognize that thereby the first actuating surface 32*a* will be lifted from the stop member 51 and the locking members 30*a*, 30*b* are released and the tensioned spring 40 will automatically move the locking members 30*a*, 30*b* in their locked position as shown in FIGS. 1, 2 and 8. The skilled person will understand that the locking members 30*a*, 30*b* are only released after the latching arms 20*a*, 20*b* of the connector housing 10 can snap into the latching groove 55 of the corresponding counter-connector (i.e. it is in its latched position).

One can further see from FIG. 8 how the actuating arm 31*a* of locking member 30*a* is now arranged between the latching arm 20*a* and a portion of the retainer 50, respectively between the plug-in portions 13. In the position shown in FIG. 8, it is not possible to move the latching arm 20*a* inwardly, i.e. towards the plug-in portion 13 so that it is impossible to bend the latching arm 20*a* out of the locking engagement with latching groove 55. The same applies for the not shown latching arm 20*b* and locking member 30*b*. An un-mating of the two connectors is only possible, after an operator manually releases the secondary locking means 30, i.e. both locking members 30*a*, 30*b*, by pulling it against the mating direction and the biasing force of spring 40.

Reference number 18 denotes electrical female terminals provided in the plug-in portion 13. The inventive concept of providing a locking means in form of two distinct locking members 30*a*, 30*b* allows a secure and reliable secondary locking of the mating, even if the primary locking means are only partially locked. The skilled person will thus recognize that the spring 40 of the illustrated embodiment is only an advantageous feature but not necessary for the inventive concept.

LIST OF REFERENCE NUMERALS

10 Connector Housing
11 Cover
12 Main body of connector housing
13 Plug-in portion
14 Electrical cables
15 Latch connection
16 Ferrite element
17 Inclined deflection surface
18 Electrical female terminals
20*a*; 20*b* Latching arms
30 Secondary locking means
30*a* locking member
30*b* locking member
31*a*; 31*b* Actuating arm of the locking members
32*a* First actuating surface
33*a* Second actuating surface
40 Spring
41*a*; 41*b* Spring arms
42 Spring coil
43 U-shaped frame
50 Retainer (part of counter-connector)
51 Stop member
52 Socket housing
55 Latching groove
62 Contact insertion length

The invention claimed is:

1. A connector assembly, comprising:

a connector housing comprising a plug-in portion and two primary latching arms arranged on opposite sides of the plug-in portion; and a secondary locking means connected to the connector housing and movable relative to the connector housing from an open position to a locked position, said secondary locking means comprises blocking portions that are configured to block a release movement of the primary latching arms when the secondary locking means is in the locked position, wherein the secondary locking means comprises two separate locking members, wherein each of the locking members is attached to one of the primary latching arms to block the release movement of the primary latching arms, and wherein each of the locking members is configured to be independently moveable between the open position and the locked position.

2. The connector assembly according to claim 1, further comprising at least one spring, being operationally connected to at least one of the locking members to bias each locking member into the locked position when the connector housing is fully mated with a corresponding counter-connector.

3. The connector assembly according to claim 2, wherein the at least one spring is arranged at the connector housing so that upon mating, each spring automatically moves the locking member operationally connected thereto in the locked position.

4. The connector assembly according to claim 3, wherein the at least one spring comprises two actuating arms, each actuating arm being operationally connected to one of the locking members, for biasing the locking members in the locked position.

5. The connector assembly according to claim 3, wherein the at least one spring comprises two actuating arms being arranged in a direction perpendicular to a mating direction and which arms are fixed on one end to the connector housing and each actuating arm is operationally connected with its other end to one locking member, for biasing the locking member in the locked position.

6. The connector assembly according to claim 3, wherein the at least one spring is arranged such that the spring is tensioned and when the locking members are in the locked position the spring is pre-loaded when the locking members are in the open position.

7. The connector assembly according to claim 1, wherein each of the locking members comprises a first actuating surface configured to be engaged by a stop member of a counter-connector, in order to hinder the locking members from moving in a mating direction during mating of the connector housing with a corresponding counter-connector.

8. The connector assembly according to claim 7, wherein the primary latching arms engage with a latching groove of the corresponding counter-connector when the connector housing is mated with the corresponding counter-connector.

9. The connector assembly according to claim 1, wherein each of the locking members comprises an actuating arm configured to latch to a corresponding counter-connector when mated and when the locking member is in the locked position.

10. The connector assembly according to claim 9, wherein each of the locking members comprises a second actuating surface, whereby the second actuating surface is configured to be engaged by an inclined deflection surface of the connector housing so that the actuating arm of each locking member is deflected when the connector housing is mated with the corresponding counter-connector.

11. The connector assembly according to claim 9, wherein the actuating arms of the locking members are integrally formed with the blocking portions.

12. The connector assembly according to claim 1, wherein a retention force of each of the locking members in fully mated condition of connector and counter-connector is greater than 78N.

13. The connector assembly according to claim 1, wherein the assembly further comprises a corresponding counter-connector, whereby the corresponding counter-connector is an airbag squib socket and the connector housing is an airbag squib connector housing.

* * * * *